US005984201A

United States Patent [19]

Hofmann et al.

[11] Patent Number: 5,984,201

[45] Date of Patent: Nov. 16, 1999

[54] FUEL INJECTION VALVE FOR INTERNAL COMBUSTION ENGINES

[75] Inventors: Karl Hofmann, Remseck; Wolfram Gerwing, Hessigheim, both of Germany

[73] Assignee: Robert Bosch GmbH

[21] Appl. No.: 08/946,971

[22] Filed: Oct. 8, 1997

[30] Foreign Application Priority Data

Oct. 10, 1996 [DE] Germany ..... 196 41 824

[51] Int. Cl.[6] ..... F02M 47/02

[52] U.S. Cl. ..... 239/127; 239/533.8

[58] Field of Search ..... 239/533.8, 533.4, 239/585.1–585.5, 124, 127

[56] References Cited

U.S. PATENT DOCUMENTS

| | | | |
|---|---|---|---|
| 3,481,542 | 12/1969 | Huber | 239/533.8 X |
| 3,610,529 | 10/1971 | Huber | 239/533.8 |
| 4,448,356 | 5/1984 | Nakajima et al. . | |
| 4,776,518 | 10/1988 | Yamamoto | 239/533.8 X |
| 4,826,086 | 5/1989 | Ogawa et al. . | |
| 4,852,808 | 8/1989 | Yamamoto . | |
| 5,458,293 | 10/1995 | Ganser | 239/533.8 |
| 5,472,142 | 12/1995 | Iwanaga | 239/533.8 X |

FOREIGN PATENT DOCUMENTS

| | | | |
|---|---|---|---|
| 39 07 569 A1 | 9/1990 | Germany . | |
| 2 092 223 | 12/1981 | United Kingdom . | |
| 2129052 | 5/1984 | United Kingdom | 239/533.8 |

*Primary Examiner*—Kevin Weldon

*Attorney, Agent, or Firm*—Edwin E. Greigg; Ronald E. Greigg

[57] ABSTRACT

A fuel injection valve for internal combustion engines, having a valve member that is guided so that it can slide axially in a bore of a valve body. The valve member has a valve sealing face on one end which cooperates with a valve seat face on the valve body and this valve member, on an end remote from the valve sealing face, is acted on in the closing direction toward the valve seat by a valve spring, as well as having another adjusting member that controls a two-stage opening stroke course of the valve member. In order to control the two-stage opening stroke course of the valve member, the adjusting member is embodied as an adjustable stop, in which the valve member comes into at least indirect contact with after passing through a partial stroke and which in a first position, is locked in its initial position and in a second position, can be moved in the opening direction by means of the valve member.

9 Claims, 2 Drawing Sheets

FUEL INJECTION VALVE FOR INTERNAL COMBUSTION ENGINES

BACKGROUND OF THE INVENTION

The invention is based on a fuel injection valve for internal combustion engines. DE-OS 39 07 569 has disclosed a fuel injection valve of this kind in which a piston-shaped valve member is guided so that it can slide axially in a bore of a valve body, which protrudes with its one end into the combustion chamber of the engine to be fed. On its combustion chamber end, the valve member has a valve sealing face with which it cooperates with a valve seat face disposed on the valve body, in order to control an opening cross section to an injection opening. On its end remote from the valve sealing face, the valve member is acted upon in the direction of the valve seat face by two valve springs disposed in series in relation to each other, of which a first valve spring continuously acts on the valve member and a second valve spring only comes into contact with the valve member after its passage through a pre-stroke path so that a two-stage opening stroke course of the valve member can be formed. This division of the injection quantity at the injection valve into a small pre-injection quantity with a small opening cross section and the main injection quantity with a large cross section permits an optimal injection and preparation as well as a low-pollutant combustion of the fuel in the combustion chamber of the engine. Furthermore, an adjustable stop acts on the second valve spring and the position of this stop can be used to change the initial stress force of the second spring and consequently the beginning of the course of the second opening stroke phase of the valve member, wherein this change, in the known injection valve should in particular permit an adaptation of the spring force to the increasing opening pressure forces acting on the valve member at high speeds of the engine.

The known fuel injection valve, however, has the disadvantage that it is not possible to freely select the second opening stroke phase independently of the load and speed of the engine.

OBJECT AND SUMMARY OF THE INVENTION

The fuel injection valve for internal combustion engines has the advantage over the prior art that the time of the second opening stroke phase can be freely selected independently of the parameters of the engine.

This is attained in an advantageous manner by providing an adjustable stop that cooperates directly with the valve member and defines its valve member opening stroke motion in a first adjustment position after the passage through the pre-stroke. The second opening stroke phase can be arbitrarily initiated by unlocking the adjustable stop, which is then slid along with the valve member until the maximal opening stroke path is achieved.

The adjustable stop is embodied in a structurally simple manner as a hydraulic adjusting piston, which with its one end face constitutes the stop face for the valve member and which with its other end face, defines a hydraulic working chamber. The locking or unlocking of the adjusting piston is carried out in a simple manner by means of the closing or opening of the hydraulic working chamber, wherein this control is carried out by means of a control valve in the pressure fluid line.

The control valve can be embodied as a 3/2-way valve that connects a pressure fluid line, which feeds into the hydraulic working chamber, to a return line (pressure relief) into a storage tank or to a high pressure injection line (pressure supply), which leads from an injection pump. In an injection system that is without pressure, in order to be able to assure the buildup of the minimum pressure that can bring the adjusting piston into the initial position, a pre-feed line that feeds into the pressure fluid line can additionally be provided, which is connected to a pre-feed pump and has a check valve that opens in the direction of the pressure fluid line.

Alternatively, the control valve can also be embodied as a solenoid valve which opens or closes a relief line that leads from the hydraulic working chamber.

The pressure fluid supply is carried out in a structurally simple manner directly by the high pressure conduit in the valve body, from which a connecting bore leads into the working chamber of the adjusting piston. For a pressure relief of the hydraulic working chamber that is as rapid as possible, a throttle location is provided in the connecting bore. Furthermore, the relief line of the work chamber simultaneously constitutes the return line from the spring chamber of the injection valve so that with the pressure relief of the working chamber, the pressure that exists in the spring chamber additionally supports a rapid displacement of the pressure fluid out from the working chamber.

The triggering of the control valves is carried out in an advantageous manner via an electronic control device that processes the parameters of the engine.

A free selection of the second partial stroke stage is possible wherein the injection valve can be totally or only partially operated in the pre-stroke range.

The stop face, which cooperates directly with the valve member or with an intermediary member (spring plate, pusher rack) rigidly connected to it, is embodied on an axial extension of the adjusting piston, which slides in a bore in a sealed fashion, and in the initial position, has a particular spacing from the valve member, which spacing determines the size of the pre-stroke.

It is particularly advantageous to guide the valve member or a pusher rack connected to it in a corresponding recess of the adjusting piston in order to thus be able to prevent imprecisions due to vibrations or offset.

Advantageous improvements and updates of the fuel injection valve disclosed herein are possible by means of the measures taken.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
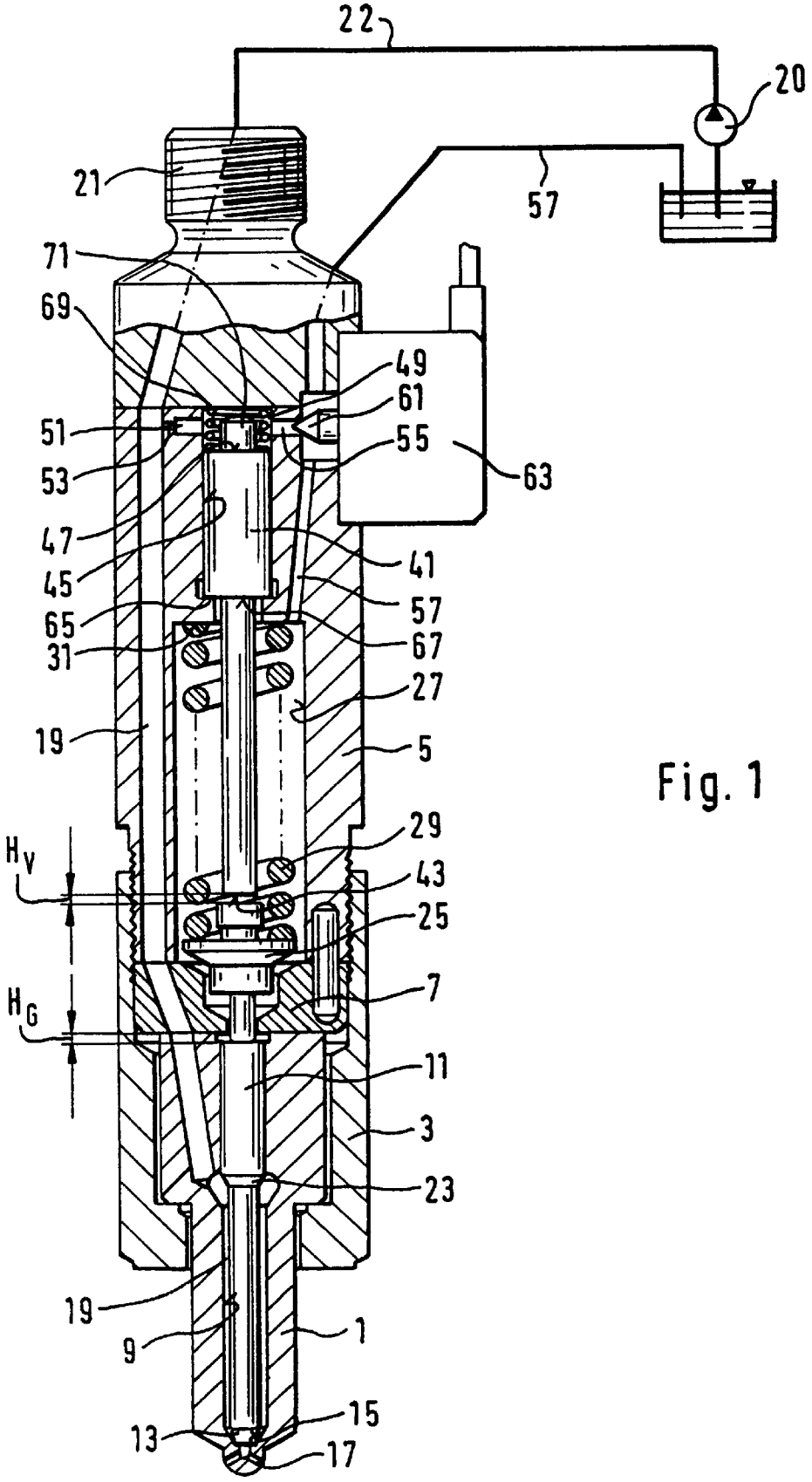
FIG. 1 shows a longitudinal section through a first exemplary embodiment of the injection valve in which the control of the hydraulic working chamber on the adjusting piston is carried out by means of a solenoid valve.

The first exemplary embodiment of the fuel injection valve according to the invention, which is shown in a longitudinal section in FIG. 1, has a rotationally symmetrical valve body 1 which protrudes with its bottom, free end into a combustion chamber, not shown, of the internal combustion engine to be fed. With its upper end face, the valve body 1 is clamped axially against a valve holding body 5 by means of an adjusting nut 3, wherein an intermediary disk 7 is clamped between the valve body 1 and the valve holding body 5. The valve body 1 has an axial blind bore 9, which leads from its upper end face and a piston-shaped valve member 11 is guided so that it can slide axially in this blind bore. The valve member 11 that is embodied as a stepped piston constitutes a valve sealing face 13 with its conical bottom end face on the combustion chamber end, which cooperates with a conical valve seat face 15 on the valve body 1. This valve seat face 15 is embodied on the bottom, inwardly protruding closed end of the blind bore 9. Downstream of the valve seat face 15, moreover, at least one injection opening 17 leads away from the blind hole of the bore 9 and feeds into the combustion chamber of the engine to be fed. Upstream, a pressure conduit 19 feeds to the valve seat 15, which conduit is formed between the valve member 11 and the wall of the bore 9 and extends via corresponding longitudinal bores through the intermediary disk 7 and the valve holding body 5 to a connection fitting 21 to which an injection line 22 that leads from an injection pump 20 can be connected. The cross sectional transition at the valve member 11 forms a pressure shoulder 23 via which the high fuel pressure supplied can engage the valve member 11 in the opening direction.

With its end, which is reduced in diameter and is remote from the combustion chamber, the valve member 11 protrudes into a through opening of the intermediary disk 7, wherein the spacing $H_G$ between the valve member shoulder and the end face of the intermediary disk 7 oriented toward the valve body 1 determines the size of the maximal opening stroke path of the valve member 11.

The end face of the valve member 11 remote from the combustion chamber rests against a spring plate 25, which protrudes into a spring chamber 27 provided in the valve holding body 5. A valve spring 29, which acts on the valve member 11 in the closing direction toward the valve seat 15, is inserted into this spring chamber 27 and is clamped between the spring plate 25 and an upper end wall 31 of the spring chamber 27.

Furthermore, on the end remote from the valve member, an adjusting piston 41, which is embodied as a stepped piston, protrudes into the spring chamber 27 with its part that is smaller in diameter, coaxially to the valve spring 29 and, with its bottom end face oriented toward the valve member, constitutes a stop face 43 which the spring plate 25 comes into contact with after passing through a particular prestroke path $H_V$ of the valve member opening stroke.

The part of the adjusting piston 41 that is larger in diameter is guided in a sealed fashion in a guide bore 45 in the valve holding body 5 and with its end face 47 remote from the valve member, defines a hydraulic working chamber 49 inside the bore 45. For the supply of pressure fluid, this working chamber 49 is connected to the fuel pressure conduit 19 via a connecting line 51, wherein a throttle location 53 is inserted in the connecting line 51. The pressure relief of the working chamber 49 is carried out via a relief line 55 leading from it, which feeds into a return line 57 leading from the spring chamber 27 and into a storage tank 59. The outlet opening of the relief line 55 into the return line 57 can be closed by a valve member 61 of an electrically triggered solenoid valve 63.

The movement of the adjusting piston 41 in the direction of the valve member 11 is defined by a shoulder 65 on the guide bore 45, which the adjustment piston 41 contacts with an annular end face 67 formed at the cross sectional transition. Furthermore, a restoring spring 69 is clamped between the upper end face 47 of the adjusting piston 41 and the opposite wall of the working chamber 49, which spring holds the adjusting piston 41 in its initial position against the shoulder 65 and is designed so that it can be overcompressed by the opening force acting on the valve member 11. In order to prevent damage to the restoring spring 69, the upper end face 47 of the adjusting piston 41 furthermore has an axially protruding pin 71 that defines a maximal adjustment path of the adjusting piston 41, wherein this adjustment path is designed to be greater than the maximal valve member stroke path $H_G$.

The fuel injection valve according to the invention functions in the following manner.

When the injection valve is closed, the valve spring 29 holds the valve member 11 with its valve sealing face 13 in sealed contact with the valve seat 15, wherein the fuel disposed in the pressure conduit 19 has a standing pressure lower than the opening pressure. The hydraulic working chamber 49 of the adjusting piston 41 is likewise filled via the connecting line 51 with the fuel acting as pressure fluid, wherein the restoring spring 69 holds the adjusting piston 41 in contact with the housing shoulder 65.

The fuel injection is initiated by the high pressure supply of fuel from the injection pump 20 to the injection valve, wherein the fuel pressure engaging the pressure shoulder 23 on the valve member 11 in the opening direction overcomes the force of the valve spring 29 at a particular opening pressure and the valve member 11 lifts inward from the valve seat 15. An opening cross section is opened between the valve seat 15 and the valve sealing face 13 and permits fuel to flow from the pressure conduit 19 to the injection openings 17, through which it is then injected into the combustion chamber of the engine.

The valve member 11 first passes only through the prestroke path $H_V$ and comes into contact with its spring plate 25 against the stop face 43, which now defines the valve member opening stroke for the time being.

In a first operating position, not shown, the closing member 61 of the solenoid valve 63 closes the relief line 55 so that the adjusting piston 41 is locked in its position and consequently prevents a further opening stroke motion of the valve member 11.

This locking of the adjusting piston 41 can be arbitrarily ended by switching the magnet valve 63, which is why the adjusting member 61 assumes the second adjustment position represented in FIG. 1. The control pressure in the working chamber 49 is rapidly reduced, wherein the throttle 53 in the connecting line 51 prevents a rapid replenishing flow of fuel. Furthermore, the draining fuel quantity in the spring chamber 27 builds up a pressure that engages the end face 67 of the adjusting piston 41 and thus additionally supports its rapid opening stroke motion.

After the unlocking of the adjustable stop 43 on the adjusting piston 41, in a second stroke phase, the further increased fuel pressure moves the valve member 11 further in the opening direction counter to the force of the valve spring 29 and the restoring spring 69 until after passing through the maximal valve member stroke $H_G$, it rests against its shoulder on the intermediary disk 7.

The ending of the fuel injection is carried out by the ending of the high pressure fuel supply, which results in the reduction of the high fuel pressure, which acts on the valve member 11 in the opening direction, to below the required opening pressure once again so that the valve spring 29 returns the valve member 11 back to the valve seat 15.

The restoring spring 69 brings the adjusting piston 41 into its initial position and the working chamber 49 fills again with fuel via the connecting line 51.

Figure 2:
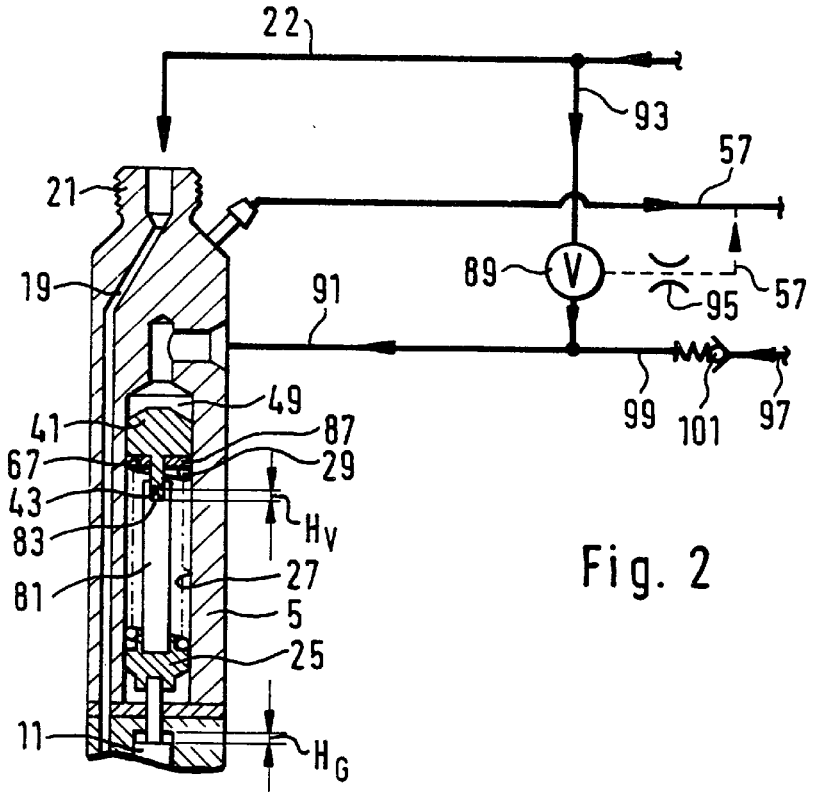
FIGS. 2 and 3 show a second exemplary embodiment of the injection valve in two adjustment positions, in which the control of the hydraulic working chamber is carried out by means of a 3/2-way valve.
Figure 3:
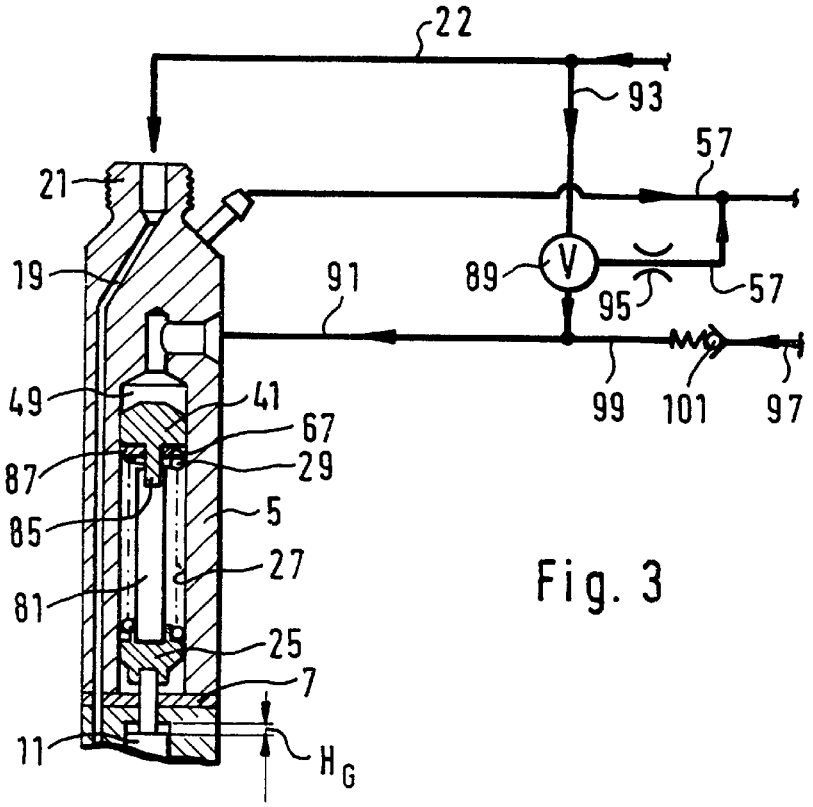

The second exemplary embodiment of the fuel injection valve according to the invention, which is represented in two operating positions in FIGS. 2 and 3, differs from the first exemplary embodiment only in the embodiment of the adjusting piston 41 and the triggering of the hydraulic working chamber 49, which is why the description of the structure and function is limited to these components. The other components correspond to the first exemplary embodiment and therefore have the same reference numerals.

The spring plate 25 of the valve member 11 in the second exemplary embodiment can be connected to the adjusting piston 41 via a pusher rack 81, which has a blind bore 83 on its top end oriented toward the adjusting piston 41; a stop pin 85 that projects axially from the adjusting piston 41 protrudes into this blind bore. The pin 85, which is guided so that it can slide axially in the blind bore 83 of the pusher rack 81, constitutes the stop face 43 with its free end face, which stop face cooperates with the closed bottom face of the blind bore 83 on the pusher rack 81 to define the pre-stroke motion of the valve member 11. The spacing between the stop face 43 on the adjusting piston 41 and the closed end of the bore 83 determines the size of the pre-stroke path $H_V$ when the valve member 11 is resting against the valve seat.

The axial position of the adjusting piston 41 in the spring chamber 27 is defined by a ring 87, which is pressed into this spring chamber, whose end face oriented toward the valve member functions as a support of the valve spring 29 and against whose other end face, the adjusting piston 41 is held with an annular end face 67 by means of the pressure in the working chamber 49.

The control of the pressure fluid loading and relief of the hydraulic working chamber 49 on the adjusting piston 41 is carried out in the second exemplary embodiment via a 3/2-way valve 89, which connects a pressure fluid line 91, which leads from the working chamber 49, to a return line 57 or to a branch line 93 of the injection line 22, wherein the draining of the fuel from the working chamber 49 can additionally be controlled by means of a throttle 95 in the return line 57.

Furthermore, a pre-feed line 99 leading from a pre-feed pump 97 feeds into the pressure fluid line 91 in which a check valve 101 is inserted, which opens in the direction of the pressure fluid line 91, and this pressure fluid line 91 is used to fill the working chamber 49 with fuel when the injection system is without pressure or in an initial filling.

The second exemplary embodiment shown in FIGS. 2 and 3 functions in the following manner.

In a first operating position of the 3/2-way valve, which is shown in FIG. 2, the working chamber 49 is connected to the injection line 22 via the lines 91 and 93 so that during the injection pauses, the standing pressure increases and during the injection phases, the high fuel pressure increases in the working chamber 49, which, due to its large end face that adjoins the working chamber, thus hydraulically locks the adjusting piston 41 in its contact with the ring 87.

The valve member opening motion is carried out analogously to the first exemplary embodiment by the high fuel pressure that engages the valve member 11 counter to the restoring force of the valve spring 29.

The first or pre-stroke motion $H_V$ of the valve member 11 is defined by the contact of the pusher rack 81 against the pin 85 of the adjusting piston 41.

If the second valve member opening stroke phase should also occur, the 3/2-way valve, as shown in FIG. 3, is switched over in such a way that the working chamber 49 is now connected to the return line 57 so that the volume in the working chamber 49 can be relieved into a relief chamber, preferably the tank.

As a result of the insufficient counterforce on the adjusting piston 41, the valve member 11 now moves the adjusting piston 41 along with it in a second stroke phase and passes through its maximal valve member stroke $H_G$ until it comes in contact with the intermediary disk 7; this maximal valve member stroke corresponds to a maximal opening cross section at the valve seat 15.

The subsequent restoring movement of the adjusting piston 41 after the end of the injection occurs after the renewed switching over of the 3/2-way valve 89, by means of the standing pressure in the injection line 22 or independently of this via the supply line 99, which refill the working chamber with fuel.

The adjustment of the time for the second opening stroke phase of the valve member 11 can be freely selected independently of the load and speed of the engine, wherein the injection valve can also be totally or only partially operated in the pre-stroke range of the valve member.

The foregoing relates to preferred exemplary embodiments of the invention, it being understood that other variants and embodiments thereof are possible within the spirit and scope of the invention, the latter being defined by the appended claims.

We claim:

1. A fuel injection valve for internal combustion engines, comprising a valve member (11) that is guided so that the valve member can slide axially in a bore (9) of a valve body (1), said valve member has a valve sealing face (13) on one end, said valve sealing face cooperates with a valve seat face (15) on the valve body (1), a valve spring (29), said valve spring acts on an end of said valve member remote from the valve sealing face (13) in a closing direction toward the valve seat (15), an adjusting piston is acted upon hydraulically to control a two-stage opening stroke course of the valve member (11), said valve member (11) comes into an indirect contact with said adjusting piston after passing through a partial stroke and in a first position said adjusting piston is locked in an initial position and in a second position said adjusting piston is moved in an opening direction by means of the valve member (11), said adjusting piston (41) includes a first end face oriented toward the valve member (11) which constitutes a stop face (43) for the valve member stroke motion and a second end face of said adjusting piston remote from the valve member (11) defines a working chamber (49) that is filled with a pressure fluid, said working chamber is relieved by a pressure line which is opened and closed by a control valve, said adjusting piston (41) is connected to the valve member (11) via a pusher rack (81), an axial play remains between the pusher rack (81) and the adjusting piston (41), which axial play defines a pre-stroke ($H_V$) when the valve member (11) is resting against the valve seat (15), a pressure fluid line (91) that feeds into the working chamber (49) is connected via the control valve to an injection line (22), which leads from a high pressure pump (20), or to a return line (57), and a pre-feed line (99) feeds into the pressure fluid line (91) into which a check valve (101) is inserted that opens in a direction of the pressure fluid line (91).

2. A fuel injection valve according to claim 1, in which the control valve is embodied as a solenoid valve (63).

3. A fuel injection valve according to claim 1, in which the control valve is embodied as a 3/2-way valve (89).

4. A fuel injection valve according to claim 1, in which the adjusting piston (41) is embodied as a stepped piston having a larger diameter part and a smaller diameter part, the larger diameter part defines the working chamber (49) and is guided in a sealed fashion in a housing bore (45) and the smaller diameter part of the stepped piston including the stop face (43) protrudes into a spring chamber (27) that contains the valve spring (29), an annular end face (67) constituted on a cross sectional transition of the stepped piston forms a contact face that cooperates with a shoulder (65) of the housing bore (45) to define an adjusting piston motion in a direction of the valve member ( 11).

5. A fuel injection valve according to claim 4, in which a restoring spring (69) is clamped between the adjusting piston (41) and a wall that defines the working chamber (49) on the second end of said adjusting piston and this restoring spring (69) holds the adjusting piston (41) in contact with the bore shoulder (65).

6. A fuel injection valve according to claim 4, in which the working chamber (49) is connected via a connecting line (51) to a fuel pressure conduit (19) that passes through the injection valve, wherein a throttle location (53) is provided in the connecting line (55).

7. A fuel injection valve according to claim 4, in which the working chamber (49) can be connected to a return line (57) of the injection valve via a relief line (55) that can be closed.

8. A fuel injection valve according to claim 1, in which on said first end oriented toward the valve member, the adjusting piston (41) has an axially projecting pin (85) which protrudes into a corresponding recess in the upper end face of the pusher rack (81) and that in the initial position of said valve member, the adjusting piston (41) rests with an annular end face (67), which is formed at a transition to the pin (85), against a stop affixed to the housing.

9. A fuel injection valve according to claim 8, in which the stop affixed to the housing is constituted by a ring (87), which is pressed into a spring chamber (27) of the injection valve and against whose end face remote from the adjusting piston (41) the valve spring (29) rests.

* * * * *